US006467445B1

(12) United States Patent
Harris

(10) Patent No.: US 6,467,445 B1
(45) Date of Patent: Oct. 22, 2002

(54) DEACTIVATION AND TWO-STEP ROLLER FINGER FOLLOWER HAVING A SLIDER BRACKET

(75) Inventor: Wayne S. Harris, Hilton, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/970,234

(22) Filed: Oct. 3, 2001

(51) Int. Cl.[7] ..... F01L 13/00

(52) U.S. Cl. ..... 123/90.16; 123/90.44; 123/90.39; 123/90.45

(58) Field of Search ..... 123/90.16, 90.48, 123/90.43, 90.44, 90.45, 90.39

(56) References Cited

U.S. PATENT DOCUMENTS 6,135,075 A * 10/2000 Boertje et al. ..... 123/90.16
6,325,030 B1 * 12/2001 Spath et al. ..... 123/198 F

OTHER PUBLICATIONS

Hendriksma et al., Deactivation and Two–Step roller Finger follower Having a Bracket and Lost Motion Spring, U.S. patent application Publication No. US 2001/0027765 A1, Oct. 11, 2001.*

Fernandez et al., Mechanical Assist Actuation Bracket for Deactivation and Two –Step Roller Finger Followers, U.S. patent application Publication No. US 2001/0045197 A, Nov. 29, 2001.*

* cited by examiner

*Primary Examiner*—Thomas Denion
*Assistant Examiner*—Ching Chang
(74) *Attorney, Agent, or Firm*—Patrick M. Griffin

(57) ABSTRACT

A roller finger follower. includes an elongate body having first and second opposing sides each having respective inside surfaces. First and second grooves are defined by the respective inside surfaces. A slider bracket includes a top plate having a top surface that is substantially perpendicular to the first and second sides. First and second projections are affixed to or integral with the top plate, and protrude therefrom in a generally parallel manner relative to the top surface. The first projection is slidably disposed within the first groove and the second projection is slidably disposed within the second groove. A locking pin assembly is carried by the slider bracket, and selectively couples and decouples the slider bracket to and from the body.

23 Claims, 3 Drawing Sheets

DEACTIVATION AND TWO-STEP ROLLER FINGER FOLLOWER HAVING A SLIDER BRACKET

TECHNICAL FIELD

The present invention generally relates to valve deactivation and two-step variable valve lift systems in internal combustion engines. More particularly, the present invention relates to a roller finger follower rocker arm device that accomplishes valve deactivation and/or cam profile mode switching in internal combustion engines.

BACKGROUND OF THE INVENTION

Deactivation roller finger followers (RFFs) typically include a body and a roller disposed on a hollow shaft. A locking pin assembly of the deactivation RFF is disposed within and carried by the hollow shaft. The locking pin assembly is switched between a coupled and a decoupled state. In the coupled state the locking pin couples the shaft to the body, whereas in the decoupled state the locking pin assembly decouples the shaft from the body. The roller is engaged by a cam of an engine camshaft. With the locking pin assembly in the coupled state/position, rotation of the cam is transferred through the roller, shaft and locking pin to pivotal movement of the RFF body. The pivoting RFF body actuates an associated engine valve. With the locking pin assembly in the decoupled state/position, rotation of the cam is not transferred to pivotal movement of the RFF body. Thus, the associated engine valve is not actuated. Rather, the shaft is reciprocated within grooves formed in the RFF body. The grooves retain and guide the reciprocation of the shaft.

A two-step RFF operates in a manner similar to a deactivation RFF. One particular difference between the operation of a deactivation RFF and a two-step RFF occurs in the decoupled mode of operation. The body of a deactivation RFF is typically engaged by zero-lift cam lobes, which maintain the deactivation RFF body in a static position. The zero-lift cam lobes do not pivot the RFF body and thus the associated engine valve is not actuated. In contrast, low lift, rather than zero lift, cam lobes engage the two-step RFF body or roller bearings affixed thereto. In the decoupled mode, the low-lift cam lobes pivot the two-step RFF body a relatively slight amount. The pivoting of the body of the two-step RFF in the decoupled mode, in turn, reciprocates the associated engine valve according to the lift profile of the low-lift cam lobe. In the coupled mode, a two-step RFF operates in a substantially similar manner to a deactivation RFF, i.e., the cam engages the roller thereby pivoting the RFF body and actuating the associated valve.

The roller and shaft of these switching RFFs (i.e., deactivation and two-step RFFs) are typically disposed within a cavity of the RFF body. The shaft and roller undergo a degree of undesirable movement or play in a direction that is generally transverse to the RFF body during their reciprocation within the grooves of the RFF body. Such movement may result in binding of the shaft and/or misalignment of the locking pin assembly, thereby making switching of the locking pin assembly less reliable. Further, such movement places substantial loading on the sides of the RFF body. The minimum width:of the RFF body is limited by the size of the high-lift roller/contact and the size of the lost-motion springs required to control the mass of the high-lift roller. Additionally, the low-lift rollers, which are mounted on the outside of the RFF body, may increase the width of the switching RFF assembly to a point where it is too wide to fit into many modern engine designs.

Therefore, what is needed in the art is a switching RFF having a reduced width.

Furthermore, what is needed in the art is a switching RFF that provides suitable high-lift contact with efficient packaging for the required lost motion springs.

Even further, what is needed in the art is a switching RFF that reduces the mass of the reciprocating high-lift roller/contact to allow a reduction in the size of the lost motion springs.

Even further, what is needed in the art is a switching RFF that provides a suitable bearing surface for the low-lift rollers and a compact. means to retain same.

Still further, what is needed in the art is an RFF that reduces the potential for locking pin assembly misalignment, thereby improving the reliability of mode switching in the RFF.

Moreover, what is needed in the art is an RFF that reduces the likelihood of the shaft binding within the grooves, thereby improving the reliability of mode switching in the RFF.

SUMMARY OF THE INVENTION

The present invention provides a deactivation and/or two-step roller finger follower for use with an internal combustion engine.

The invention comprises, in one form thereof, an elongate body having first and second opposing sides each having respective inside surfaces. First and second grooves are defined by the respective inside surfaces. A slider bracket includes a top plate having a top surface that is substantially perpendicular to the first and second sides. First and second projections are affixed to or integral with the top plate, and protrude therefrom in a generally parallel manner relative to the top surface. The first projection is slidably disposed within the first groove and the second projection is slidably disposed within the second groove. A locking pin assembly is carried by the slider bracket, and selectively couples and decouples the slider bracket to and from the body.

An advantage of the present invention is that the RFF has a reduced width.

Another advantage of the present invention is that the RFF provides a suitable high-lift contact with efficient packaging for the required lost motion springs.

A further advantage of the present invention is that the RFF has a suitable bearing surface for the low-lift rollers and a compact means to retain same.

A still further advantage of the present invention is a reduction of movement of the shaft in a direction generally transverse to the RFF body and/or grooves thereof, and thereby increases reliability in the operation of the locking pin assembly.

An even further advantage of the present invention is a reduced likelihood of locking pin misalignment, and thus increased reliability in mode switching of the RFF.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplifications set out herein illustrate the preferred embodiments of the invention and such exemplifications are not to be construed as limiting the scope of the invention in any manner.

DESCRIPTION OF THE PREFERRED EMBODIMENTS

Figure 1:
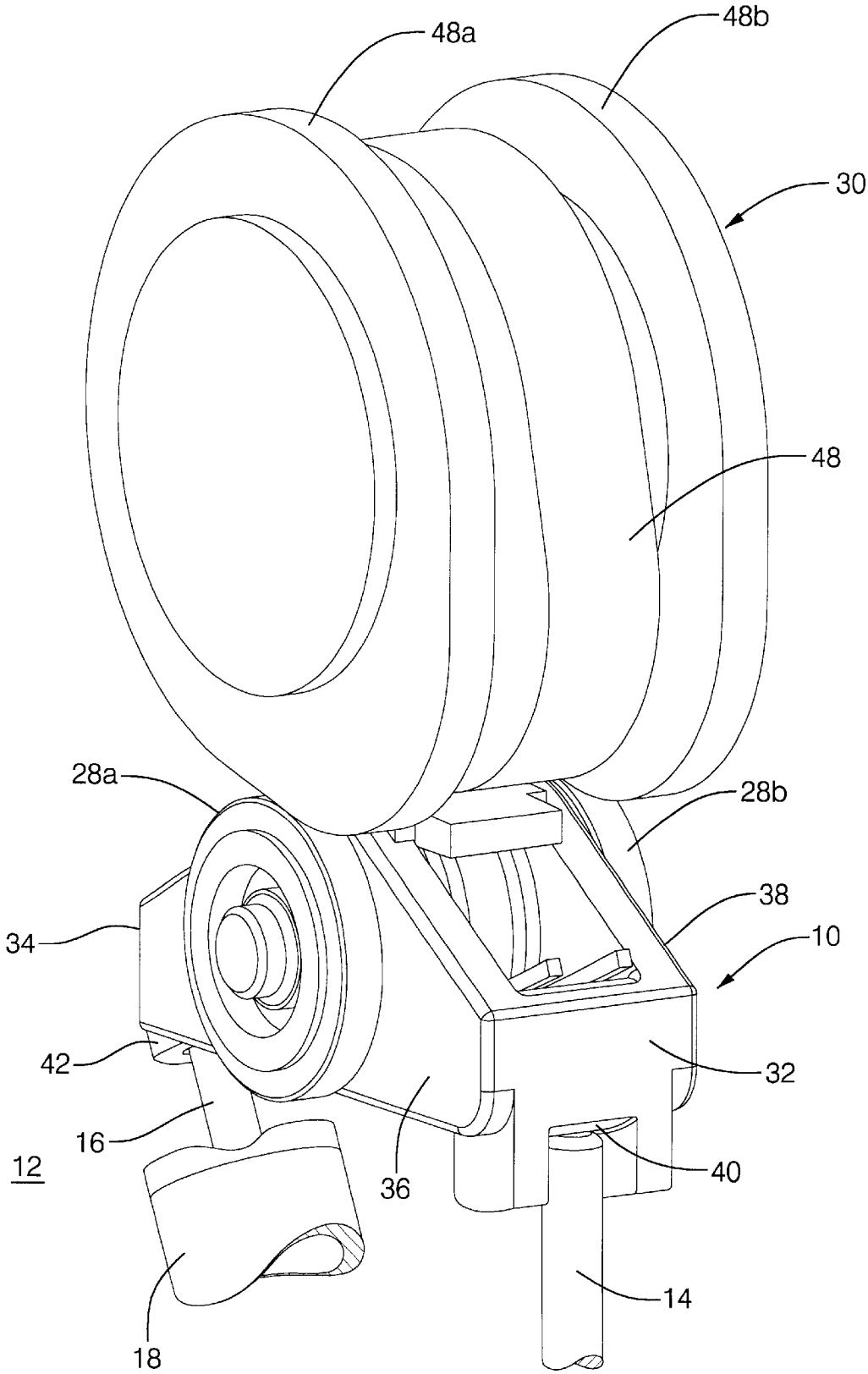
FIG. 1 is a perspective view of one embodiment of a roller finger follower of the present invention operably installed in an engine.

Referring now to the drawings, and particularly to FIG. 1, there is shown one embodiment of a roller finger follower of the present invention. Roller finger follower (RFF) 10 is installed in internal combustion engine 12. A first end of RFF 10 engages valve stem 14 of engine 12, a second end engages a stem 16 of lash adjuster 18.

Figure 2:
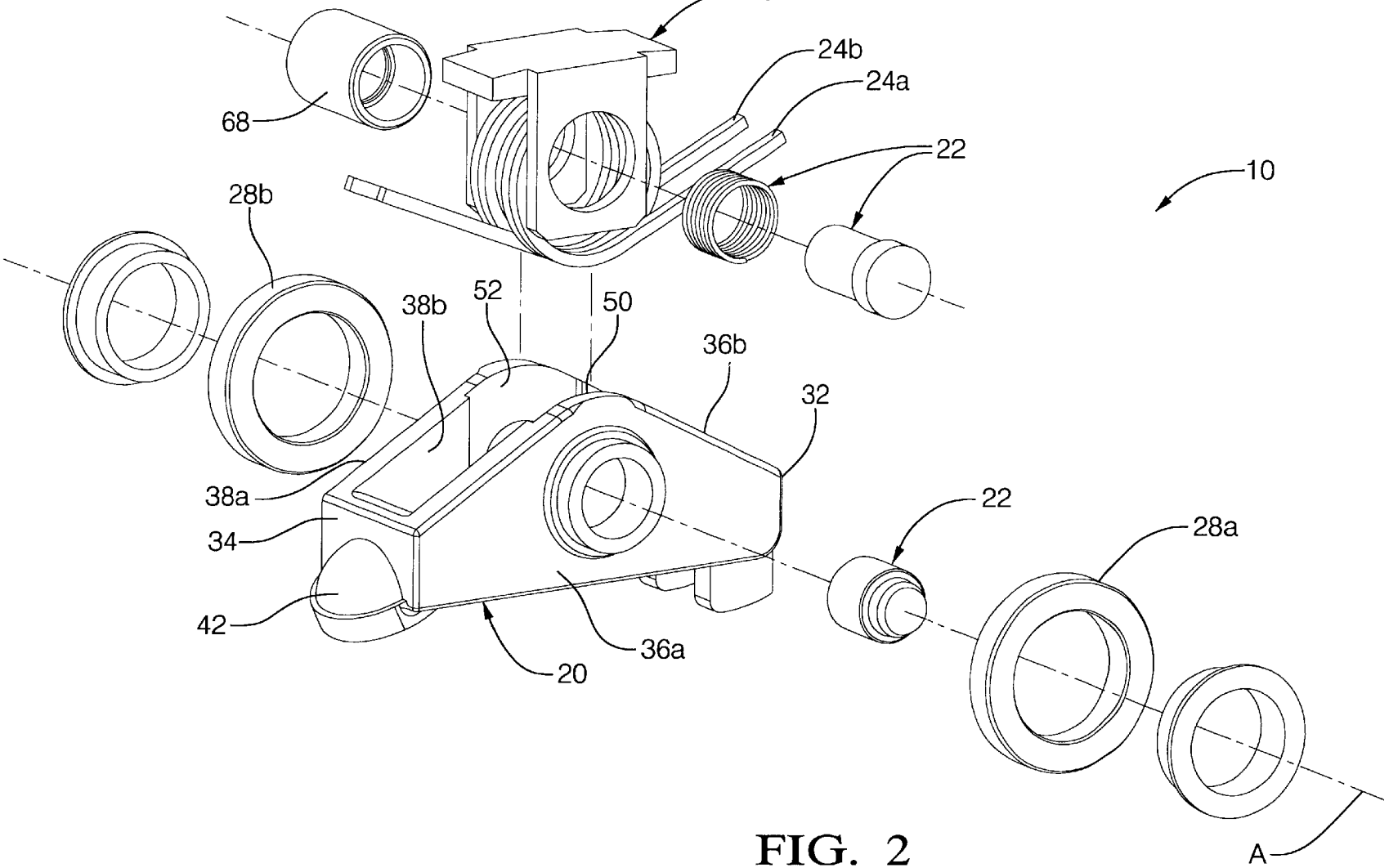
FIG. 2 is an exploded view of the RFF of FIG. 1.

Referring now to FIG. 2, RFF 10 includes body 20, locking pin assembly 22, lost motion springs 24*a*, 24*b*, slider bracket 26, and roller bearings 28*a*, 28*b*. As will be more particularly described hereinafter, slider bracket 26 and roller bearings 28*a*, 28*b* engage camshaft 30 (FIG. 1) of engine 12.

Body 20 includes first end 32, second end. 34, elongate first side member 36 (FIG. 1), and elongate second side member 38 (FIG. 1). First end 32 includes valve stem seat 40, which receives valve stem 14 of engine 12. Second end 34 defines a semispherical lash adjuster socket 42, which receives lash adjuster stem 16 of engine 12. Each of first side member 36;and second side member 38 includes a respective outside surface 36*a*, 38*a*. Roller bearings 28*a*, 28*b* are rotatably disposed, such as, for example, on flanged retainers, bosses or studs (not referenced), which are affixed to outside surfaces 36*a*, 38*a*, respectively. Roller bearings 28*a*, 28*b* rotate freely relative to and generally concentric with axis A.

The outer surface (not referenced) of outer roller 28*a* engages low- or zero-lift cam lobe 48*a* (FIG. 1) and the outer surface (not referenced) of outer roller 28*b* engages low- or zero-lift cam lobe 48*b* (FIG. 1). Low- or zero-lift cam lobes 48*a*, 48*b* are configured with one of a low lift relative to high-lift cam lobe 48 (FIG. 1) or with substantially zero lift. High-lift cam lobe 48 is disposed between cam lobes 48*a*, 48*b* on camshaft 30, and has high lift profile relative to cam lobes 48*a*, 48*b*.

First side member 36 and second side member 38 include inside surfaces 36*b*, 38*b*, respectively. Inside surface 36*b* defines groove 50 and inside surface 38*b* defines groove 52. Grooves 50 and 52 extend respectively from a top surface of first and second side members 36, 38 at least partially toward a bottom surface thereof.

Locking pin assembly 22 is switched from a coupled position to a decoupled position to thereby couple and decouple slider bracket 26 to and from body 20. Hereinafter, RFF 10 is referred to as being in the coupled mode of operation when locking pin assembly 22 is in the coupled position. Similarly, RFF 10 is referred to as being in the decoupled mode of operation when locking pin assembly 22 is in the decoupled position. The structure and operation of locking pin assembly 22, and cooperating features of RFF body 20, are more particularly described in commonly-assigned U.S. Pat. application Ser. No. 09/664,668, the disclosure of which is incorporated herein by reference. Locking pin assembly has central axis A.

Lost motion springs 24*a*, 24*b* bias slider bracket 26 in a direction towards camshaft 30 when locking pin assembly 22 is in the decoupled position. A first end of each lost motion spring 24*a*, 24*b* engages first end 32 of body 20 proximate first side 36 and second side 38, respectively, thereof. A second end of each lost motion spring 24*a*, 24*b*, engages second end 34 of body 20 proximate a respective one of first side 36 and second side 38. Lost motion springs 24*a* and 24*b* are configured as, for example, torsion springs, and are constructed of, for example, chrome silicon.

Figure 3:
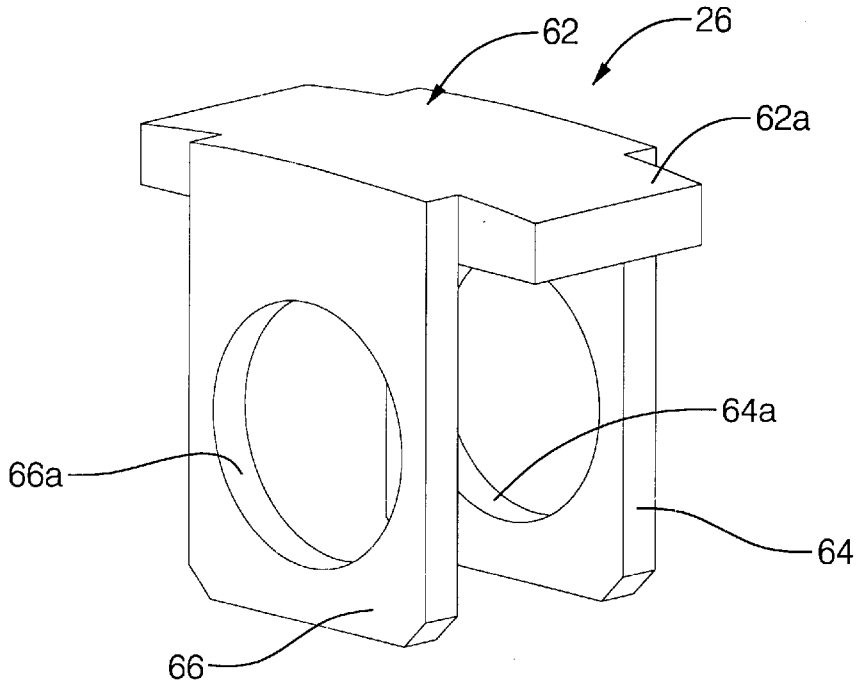
FIG. 3 is a perspective view of the slider bracket of FIG. 2.

Slider bracket 26, as best shown in FIG. 3, includes top plate 62, first leg 64 and second leg 66. Top plate 62 has a substantially flat top surface 62*a*, such as, for example, a machined surface. Top surface 62*a* is alternatively configured with a suitably crowned top surface. Each of first and second legs 64, 66 are attached to or integral with top plate 62, and extend in a substantially perpendicular manner from respective sides of top plate 62 in a direction opposite from top surface 62*a*. Further, first and second legs 64, 66 protrude in a substantially parallel and coplanar manner with, and in opposite directions away from, top surface 62*a* to thereby form a section of top surface 62*a* of increased width.

First and second legs 64, 66 are slidingly disposed within grooves 50, 52 and have widths that are dimensioned to match, with relatively close tolerances, the widths of grooves 50, 52. The closely matched widths of first and second legs 64, 66 and of grooves 50, 52, substantially eliminates any movement of slider bracket 26 within grooves 50, 52 in a direction generally transverse to central axis A. Further, the outside surfaces (not referenced) of first and second legs 64, 66 are spaced apart from each other to match, with relatively, close tolerances, the distance that separates the inside surfaces (not referenced) of grooves 50, 52. The closely matched spacing of first and second legs 64, 66 with the distance between the grooves 50, 52 substantially eliminates movement of slider bracket 26 in a direction generally parallel with central axis A. Each of first and second legs 64, 66 define respective orifices 64*a*, 66*a*, which receive hollow shaft 68 (FIG. 2).

Shaft 68 extends between first and second legs 64, 66. As described above, shaft 68 is received within orifices 64*a*, 66*a*. However, it is to be understood that shaft 68 can be alternately configured, such as, for example, affixed to first and second legs 64, 66 such that the hollow passage through shaft 68 is substantially concentric relative to orifices 64*a*, 66*a*. Further, it is to be understood that shaft 68 can be alternately configured, such as, for example, integral with first and second legs 64, 66. Locking pin assembly 22 is disposed and carried within shaft 68. Lost motions springs 24*a*, 24*b* are coiled around shaft 68, and exert a force thereon in a direction toward camshaft 30 when RFF 10 is in the decoupled mode of operation. Lost motion springs 24*a*, 24*b* are alternatively configured to be associated, such as, for example, affixed to or engaging slider bracket 26, and to exert a force thereon in a direction toward camshaft 30 when RFF 10 is in the decoupled mode of operation.

In use, RFF 10 is disposed such that top surface 62*a* of top plate 62 engages high-lift cam lobe 48, valve stem seat 40 receives valve stem 14, and lash adjuster socket 42 engages lash adjuster stem 16. Roller bearings 28*a*, 28*b* engage a respective low- or zero-lift cam; lobe 48*a*, 48*b* of camshaft 30, thereby preventing undesirable pump up of lash adjuster 18 due to oil pressure.

In the coupled position, locking pin assembly 22 couples slider plate 26 to body 20. With slider plate 26 coupled to body 20, rotary motion of high-lift cam lobe 48 is transferred to pivotal movement of body 20 relative to lash adjuster 18. The pivotal movement of body 20 relative to lash adjuster 18, in turn, reciprocates valve stem 14 thereby actuating a corresponding valve of engine 12. With slider plate 26 coupled by locking pin assembly 22 to body 20, slider plate 26 does not move relative to body 20. Therefore, lost motion springs 24*a*, 24*b* are not compressed when locking pin assembly 22 is in the coupled position. A valve spring (not shown) biases valve stem 14 towards the closed position. Valve stem 14, in turn, biases RFF 10 toward camshaft 30. Therefore, the force due to the valve spring maintains the contact between top surface 62*a* of top plate 62 and high-lift cam lobe 48.

In the deactivated/decoupled mode, locking pin assembly 22 does not couple slider plate 26 to body 20. Thus, rotary motion of high-lift cam lobe 48 is transferred to reciprocal movement of slider plate 26 relative to body 20 in a direction toward and away from camshaft 30. More particularly, as slider plate 26 reciprocates relative to body 20, legs 64, 66 reciprocate within grooves 50, 52, of body 20, thereby guiding the reciprocation of slider plate 26. Slider plate 26 carries locking pin assembly 22, and thus rotary motion of high-lift cam lobe 48 is also transferred to reciprocation of locking pin assembly 22 relative to body 20.

With RFF 10 in the decoupled mode, as described above, slider plate 26 reciprocates relative to body 20 in a direction toward and away from camshaft 30. Thus, rotary motion of high-lift cam lobe 48 is not transferred by slider plate 26 to pivotal movement of body 20. In the case that low- or zero-lift cam lobes 48*a*, 48*b* are configured as zero-lift cam lobes, body 20 is not pivoted relative to lash adjuster 18 and valve stem 14 is not reciprocated. Thus, the corresponding valve of engine 12 is not actuated. In the case that low- or zero-lift cam lobes 48*a*, 48*b* are configured as low-lift cam lobes, body 20 is pivoted relative to lash adjuster 18 according to the low-lift profile of the cams 48*a*, 48*b* due to the engagement of low-lift cam lobes 48*a*, 48*b* with roller bearings 28*a*, 28*b*, respectively. Thus, valve stem 14 is reciprocated an amount that corresponds to the low-lift profile of the cams 48*a*, 48*b*, and the associated valve is actuated, i.e., opened, a correspondingly small amount.

As slider bracket 26 reciprocates, first and second legs 64, 66 reciprocate or slide within each of grooves 50, 52 in a direction toward and away from camshaft 30. As described above, legs 64, 66 are dimensioned to closely engage grooves 50, 52, respectively, with close tolerances. The close engagement of legs 64, 66 within grooves 50, 52 retains and guides the movement of slider bracket 26. Thus, slider bracket 26 is substantially precluded from moving in a transverse direction, i.e., in a direction toward and/or away from first end 32 of body 20, by the engagement of legs 64, 66 within grooves 50, 52, respectively. Further, slider bracket 26 is substantially precluded from moving in a generally axial direction by the spacing of legs 64, 66 relative to the separation of grooves 50, 52. Bracket 26 carries locking pin assembly 22 and shaft 68. Since bracket 26 is substantially precluded from both axial and transverse movement, shaft 68 and locking pin assembly 22 are also substantially precluded from such movement. Therefore, shaft 68 is substantially precluded from binding within grooves 50, 52, and the reliability of the switching of locking pin assembly 22 between the coupled and decoupled position is substantially improved.

In the decoupled state, lost motion springs 24*a*, 24*b* absorb the reciprocation of slider bracket 26 within grooves 50, 52 in a direction toward and away from camshaft 30, and ensure that top surface: 62*a* remains in contact with high-lift cam lobe 48. Lost motion springs 24*a*, 24*b* apply a spring force or load upon shaft 68, which is carried by or integral with slider bracket 26. Thus, lost motion springs 24*a*, 24*b* bias bracket 26 and locking pin assembly 22 in the direction towards camshaft 30. The lost motion springs 24*a*, 24*b* are efficiently packaged within the width of top plate 62*a*.

As high-lift cam lobe 48 is rotated from a low-lift to a higher lift position/profile, a downward force is exerted upon slider bracket 26. In the decoupled position, this force is transmitted to lost motion springs 24*a*, 24*b* by bracket 26. The force of lost motion springs 24*a*, 24*b* is overcome by the force exerted by high-lift cam lobe 48 upon top plate 62 of slider bracket 26, and slider bracket 26 is slidingly displaced within grooves 50, 52 in a direction away from camshaft 30. The spring constants of lost motion springs 24*a*, 24*b* are selected such that the resultant and combined spring force thereof is a predetermined amount less than the spring force of the valve spring (not shown) attached to valve stem 14. Thus, when the load on slider bracket 26 is transmitted to lost motion springs 24*a*, 24*b*, the valve spring is not compressed and valve stem 14 is not reciprocated. Therefore, the downward motion of slider bracket 26 is absorbed by lost motion springs 24*a*, 24*b*.

As high-lift cam lobe 48 is rotated from a higher lift position to a lower lift position, the load exerted by lost motion. springs 24*a*, 24*b* upon slider bracket 26 maintains top surface 62*a* in contact with high-lift cam lobe 48. As high-lift cam lobe 48 returns to its zero lift profile, lost motion springs 24*a*, 24*b* bias slider bracket 26 within grooves 50, 52 in the direction of camshaft 30 and into a position which enables the return of locking pin assembly 22 to the decoupled position.

Figure 4:
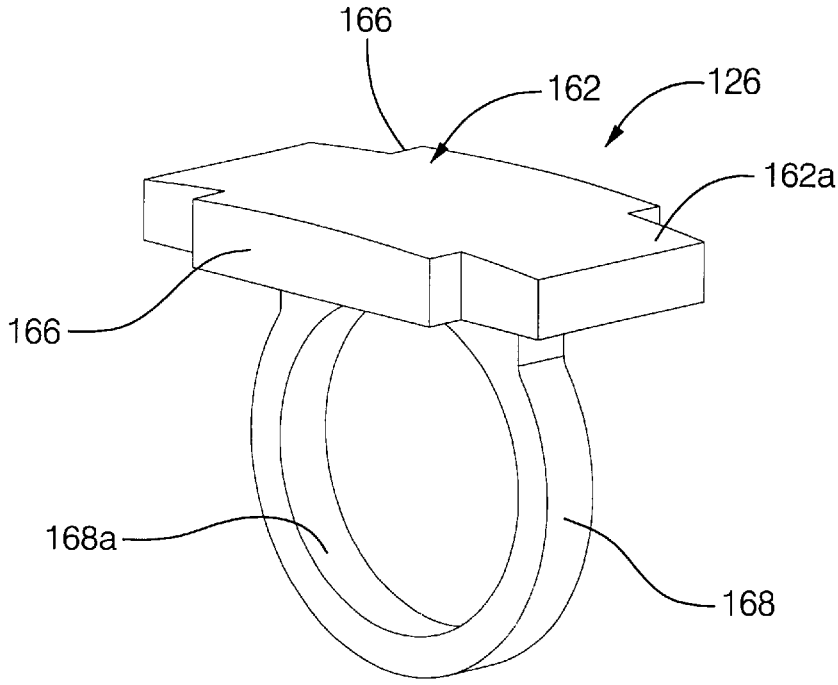
FIG. 4 is a perspective view of a second embodiment of the slider bracket of FIG. 2.

Referring now to FIG. 4, a second embodiment of a slider plate for use with the RFF of the present invention is shown. Slider bracket 126 includes top plate 162, projections 164, 166, and wall 168.

Top plate 162 includes a substantially flat top surface 162*a*, such as, for example, a machined surface. Each of projections 164, 166 are attached to and/or integral with top plate 162, and protrude in a direction away from, and in a substantially parallel and coplanar manner relative to, top surface 162*a*. Thus, projections 164, 166 form a section of top surface 162*a* having an increased width. Projections 164, 166 are configured for being slidingly disposed within grooves 50, 52 (FIG. X) of RFF 10, and are dimensioned to match with relatively close tolerances the widths of grooves 50, 52, thereby substantially eliminating any movement of slider bracket 126 within grooves 50, 52 in a direction generally transverse to central axis A. Further, the outside surfaces (not referenced) of projections 164, 166 are spaced apart from each other to match, with relatively close tolerances, the distance that separates the inside surfaces (not referenced) of grooves 50, 52, thereby substantially eliminating movement of slider bracket 126 in a direction generally parallel with central axis A.

Wall 168 is attached to or integral with top plate 162. Wall 168 extends in a substantially perpendicular manner relative to top plate 162, and is disposed on an opposite side of top plate 162 relative to top surface 162*a*. Wall 168 is disposed approximately at the middle of the width of top plate 162. Wall 168 is configured for being disposed between the inside surfaces 36*b*, 38*b* of first and second sides 36, 38, respectively, of RFF 10. wall 168 defines orifice 168*a*, which receives shaft hollow shaft 68 (FIG. 2) within which locking pin assembly 22 is at least partially disposed and carried.

Alternatively, hollow shaft 68 is formed integrally and monolithically with wall 168 or affixed thereto.

Slider bracket 26 and 126 has a substantially reduced mass relative to a high-lift or center roller used in conventional switching RFFs. Thus, the reciprocating mass of RFF 10 is substantially reduced. A corresponding reduction in the size of lost motion springs 24*a*, 24*b* is enabled, thereby resulting in a narrower, more compact body of RFF 10.

In the embodiment shown, slider brackets 26 and 126 are used with RFF 10, which is configured as a two-step roller finger follower. However, it is to be understood that the slider brackets of the present invention can be alternately configured, such as, for example, for use with a deactivation roller finger follower.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in,the art to which this invention pertains and which fall within the limits of the appended claims.

What is claimed:

1. A roller finger follower, comprising:

an elongate body having a first side and a second side opposite said first side, each of said first and second sides having respective inside surfaces, a first groove defined by said inside surface of said first side, a second groove defined by said inside surface of said second side;

a slider bracket having a top plate substantially perpendicular to said first and second sides, said top plate having a top surface, first and second projections being one of affixed to and integral with said top plate and protruding therefrom in a generally parallel manner relative to said top surface, said first projection being slidably disposed within said first groove, said second projection being slidably disposed within said second groove; and a locking pin assembly carried by said slider bracket, said locking pin assembly selectively coupling and decoupling said slider bracket to and from said body.

2. The roller finger follower of claim 1, wherein each of said first projection and said second projection are configured for limiting movement of said slider bracket in a direction that is generally transverse to a central axis of said locking pin assembly.

3. The roller finger follower of claim 1, wherein each of said first projection and said second projection are configured for limiting movement of said bracket in a direction that is generally parallel with said central axis of said locking pin assembly.

4. The roller finger follower of claim 1, wherein each of said first and second projections comprise respective first and second legs, said first and second legs being one of affixed to and integral with said top plate and protruding therefrom in a generally parallel manner relative to said top surface, said first and second legs also extending a predetermined distance in a direction away from and substantially perpendicular relative to said top surface, at least a 1portion of said first and second legs slidably disposed within a corresponding one of said first and second grooves.

5. The roller finger follower of claim 4, further comprising:

a first shaft orifice defined through said first leg;

a second shaft orifice defined through said second leg, said first shaft orifice and said second shaft orifice being substantially concentric relative to each other; and a hollow shaft received within each of said first and second shaft orifices.

6. The roller finger follower of claim 4, further comprising a hollow shaft integral and monolithic with said first and second legs, said shaft extending between said first and second legs.

7. The roller finger follower of claim 4, further comprising first and second roller bearings, said first and second roller bearings being rotatably connected to an outside surface of a respective one of said first and second sides of said body.

8. The roller finger follower of claim 7, further comprising at least one lost motion spring biasing said slider bracket in a direction toward said camshaft.

9. The roller finger follower of claim 4, wherein said top surface is a substantially flat, machined surface.

10. The roller finger follower of claim 1, wherein said first and second projections are substantially parallel and coplanar with said top surface.

11. The roller finger follower of claim 1, further comprising a wall, said wall being one of integral with and affixed to said top plate on a surface thereof opposite said top surface, said wall extending from said top plate in a substantially perpendicular manner relative to said top surface.

12. The roller finger follower of claim 11, wherein said wall further comprises an elongate hollow shaft, said shaft extending from said wall in a direction towards each of said first and second sides of said body, said shaft configured for receiving and carrying said locking pin assembly.

13. The roller finger follower of claim 12, wherein said shaft is integral and monolithic with said wall.

14. A slider bracket assembly for use with a roller finger follower, said roller finger follower having first and second opposing sides, a first groove disposed on an inside surface of said first side, a second groove disposed on an inside surface of said second side, said slider bracket comprising:

a top plate having a top surface substantially perpendicular to said first and second sides;

a first projection being one of affixed to and integral with said top plate and protruding therefrom in a generally parallel manner relative to said top surface, said first projection configured for being slidably disposed within said first groove; and a second projection being one of affixed to and integral with said top plate and protruding therefrom in a generally parallel manner relative to said top surface, said second projection configured for being slidably disposed within said second groove.

15. The slider bracket assembly of claim 14, wherein each of said first and second projections comprise respective first and second legs, said first and second legs being one of affixed to and integral with said top plate and protruding therefrom in a generally parallel manner relative to said top surface, said first and second legs also extending from said top plate a predetermined distance in a direction substantially perpendicular relative to and away from said top surface, at least a portion of said first and second legs configured for being slidably disposed within a corresponding one of said first and second grooves.

16. The slider bracket assembly of claim 15, further comprising:

a first shaft orifice defined through said first leg;

a second shaft orifice defined through said second leg, said first shaft orifice and said second shaft orifice being substantially concentric relative to each other.

17. The slider bracket assembly of claim 16, further comprising an elongate hollow shaft, said shaft configured for being received within each of said first and second shaft orifices.

18. The slider bracket assembly of claim 15, further comprising a hollow shaft, said hollow shaft being integral and monolithic with said first and second legs and extending there between.

19. The slider bracket assembly of claim 14, further comprising a wall, said wall being one of integral with and affixed to said top plate on a surface thereof opposite said top surface, said wall extending from said top plate in a substantially perpendicular manner relative to said top surface.

20. The slider bracket assembly of claim 19, wherein said wall further comprises an elongate hollow shaft, said shaft extending from said wall in a direction towards each of said first and second sides of said body, said shaft configured for receiving and carrying a locking pin assembly.

21. The slider bracket assembly of claim 20, wherein said shaft is integral and monolithic with said wall.

22. The slider bracket assembly of claim 14, wherein said first and second projections extend in a substantially parallel and coplanar manner relative to said top surface.

23. An internal combustion engine, comprising:

a roller finger follower having a slider bracket, said slider bracket including:

an elongate body having a first side and a second side opposite said first side, each of said first and second sides having respective inside surfaces, a first groove defined by said inside surface of said first side, a second groove defined by said inside surface of said second side;

a slider bracket having a top plate substantially perpendicular to said first and second sides, said top plate having a top surface, first and second projections being one of affixed to and integral with said top plate and protruding therefrom in a generally parallel manner relative to said top surface, said first projection being slidably disposed within said first groove, said second projection being slidably disposed within said second groove;

a locking pin assembly carried by said slider bracket and selectively coupling and decoupling said bracket to and from said body.

* * * * *